United States Patent [19]

Ching-ho

[11] Patent Number: 4,890,691

[45] Date of Patent: Jan. 2, 1990

[54] MUFFLER

[76] Inventor: Chen Ching-ho, 5F, No. 10, Lane 197, Sec. 1,Jy Yuh Rd.,Shyh Lin, Taipei, Taiwan

[21] Appl. No.: 271,908

[22] Filed: Nov. 16, 1988

[51] Int. Cl.[4] ..... F01N 1/08

[52] U.S. Cl. ..... 181/264; 181/272; 181/281

[58] Field of Search ..... 181/255, 264, 270, 281, 181/272

[56] References Cited

U.S. PATENT DOCUMENTS

| | | | |
|---|---|---|---|
| 1,184,431 | 5/1916 | Dodge | 181/269 |
| 2,485,555 | 10/1949 | Bester | 181/280 |
| 2,903,085 | 9/1959 | Miller | 181/255 |

FOREIGN PATENT DOCUMENTS

| | | | |
|---|---|---|---|
| 360560 | 11/1931 | United Kingdom | 181/264 |

*Primary Examiner*—B. R. Fuller

*Attorney, Agent, or Firm*—Bacon & Thomas

[57] ABSTRACT

A muffler for impeding and reflecting exhaust to reduce the formation of sound waves through a plurality of cone and barrier assemblies alternately and longitudinally spaced in a cylindrical body, with the apex of a conical member of each cone assembly and an outwardly extending cylindrical portion of each barrier assembly being directed towards the input end of the body. Exhaust flow paths for dissipating exhaust noise are defined by orifices formed in the conical members and cylindrical portions, and spaces between spokes joining each conical member to a circular member.

10 Claims, 3 Drawing Sheets

MUFFLER

BACKGROUND OF THE INVENTION

1. Field of the Invention:

This invention relates to a muffler, more particularly, to a muffler capable of eliminating the noise caused by the exhaust without over impeding the flow of the exhaust.

2. Description of the Prior Art:

The muffler is designed to reduce the sound wave so that the noise out of a car can be lowered to an extent which is within physical tolerance and permission of law.

FIGS. 1 and 2 are the cross-sections of two conventional mufflers. FIG. 1 is a bored and straight passage type of muffler which is usually installed on a sports car to make the exhaust flow in relatively large quantity thus creating a greater power. FIG. 2 is a barrier plate type of muffler which is made of plural bored plates or other barrier plates, and is widely used in the production of a large number of cars. This type of muffler can lower the flowing speed of the exhaust when it enters the inner barrier plate of the muffler so that the formation of sound waves can be prevented.

Both of the aforesaid two mufflers have their advantages and disadvantages. The former permits the engine to exhaust smoothly but the noise produced by the exhaust is too high. The latter can lower the noise by impeding the flow of exhaust but its excessive interception of exhaust flow can result in a high resistance and an increase of back pressure, thus greatly reducing the efficiency of the engine. cl SUMMARY OF THE INVENTION The purpose of the present invention is to provide an improved exhausting muffler which not only can have a relatively high rate of flow of exhaust to reduce as much as possible the damage of engine but also can lower the noise to the minimum extent.

According to the present invention, the muffler comprises a bollow main body with a connecting pipe at each of its two ends which can connect with the exhaust pipe and the end pipe, plural steel circles fixed to the inner portion of the main body for partitioning the main body into separate spaces, a cone integrated with each steel circle for dissipating the exhaust and make it expand and cool, and a barrier plate fixed to the right side of each steel circle which is used to have the exhaust impeded and reflected back to flow away through a cylinder at each center of the barrier plate so as to reduce the speed of its flow and prevent the formation of sound waves.

On the surface of the aforesaid cone and cylinder pipe are a series of orifices which can absorb or weaken the high pressure vibration of the exhaust stream in order to lower the noise.

For the other objectives and features of the present invention, refer to the detailed description of the preferred embodiment along with the drawings.

BRIEF DESCRIPTION OF THE DRAWINGS

FIG. 3 is a perspective view, partly in cross section of a muffler of the present invention.

DETAILED DESCRIPTION OF THE PREFERRED EMBODIMENT

Figure 1:
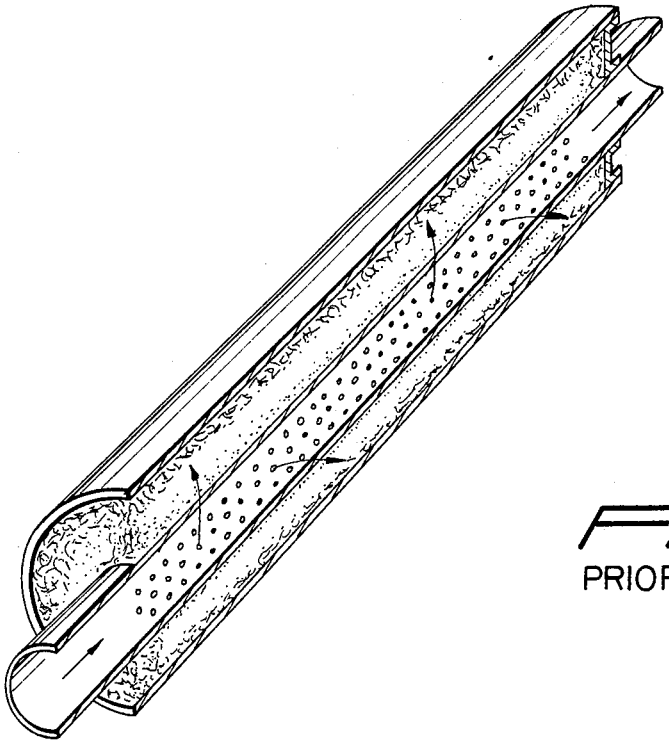
FIG. 1 PRIOR ART
FIG. 1 is a perspective view, partly in cross section, of a conventional bored and straight passaged muffler wherein the arrows indicate the flow paths of the exhaust through the muffler.
Figure 2:
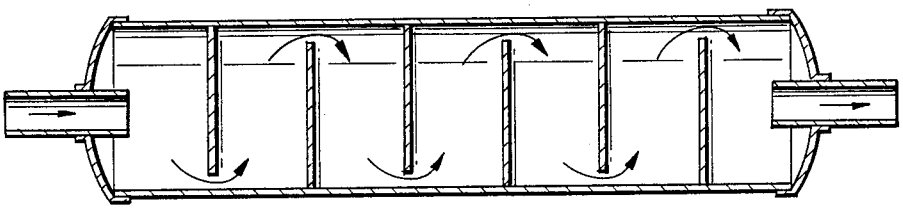
FIG. 2 PRIOR ART
FIG. 2 is a longitudinal cross sectional view of a conventional muffler of the barrier plate type wherein the arrows also indicate the flow paths of the exhaust through the muffler.
Figure 9:
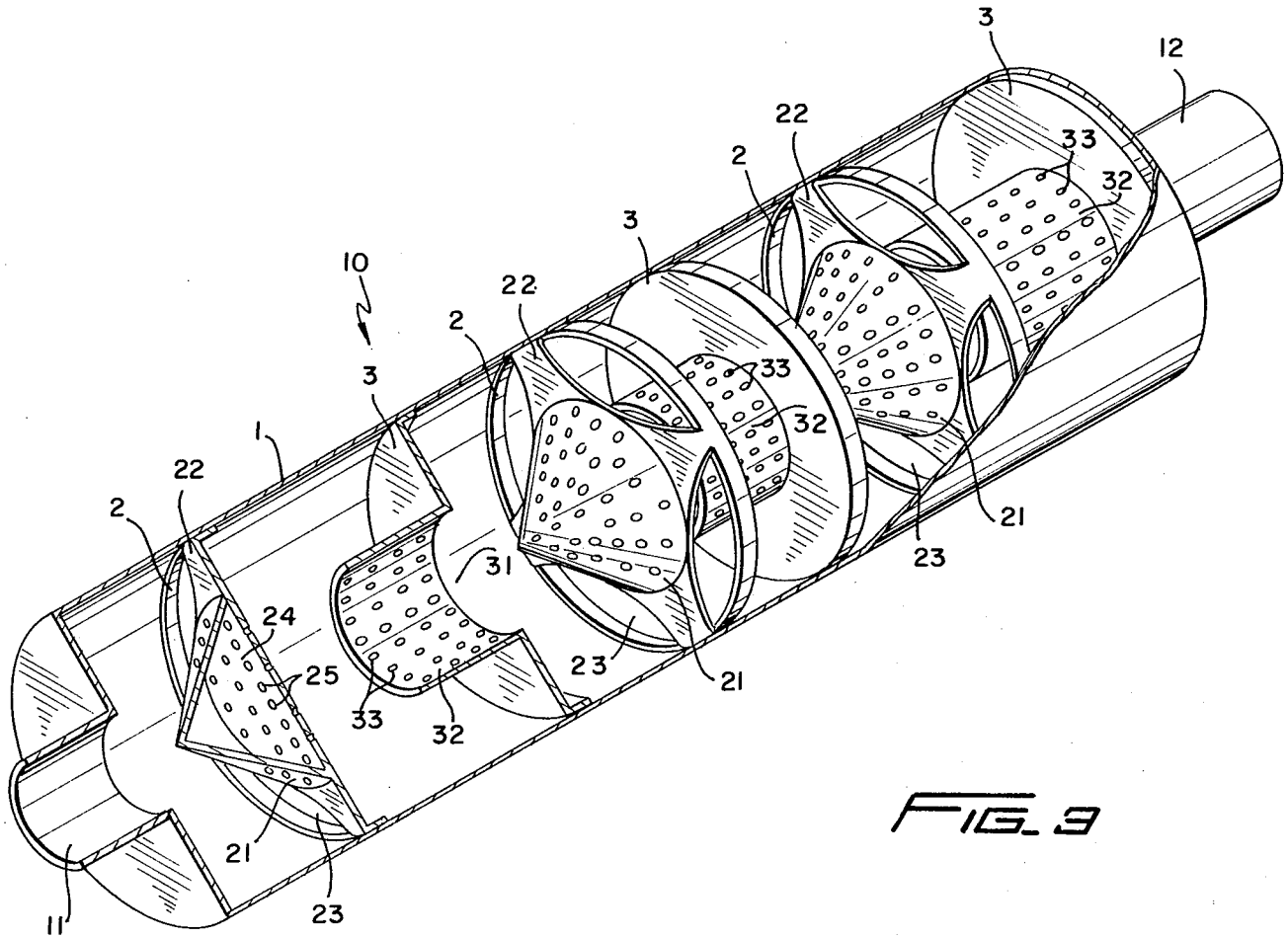
Figure 4:
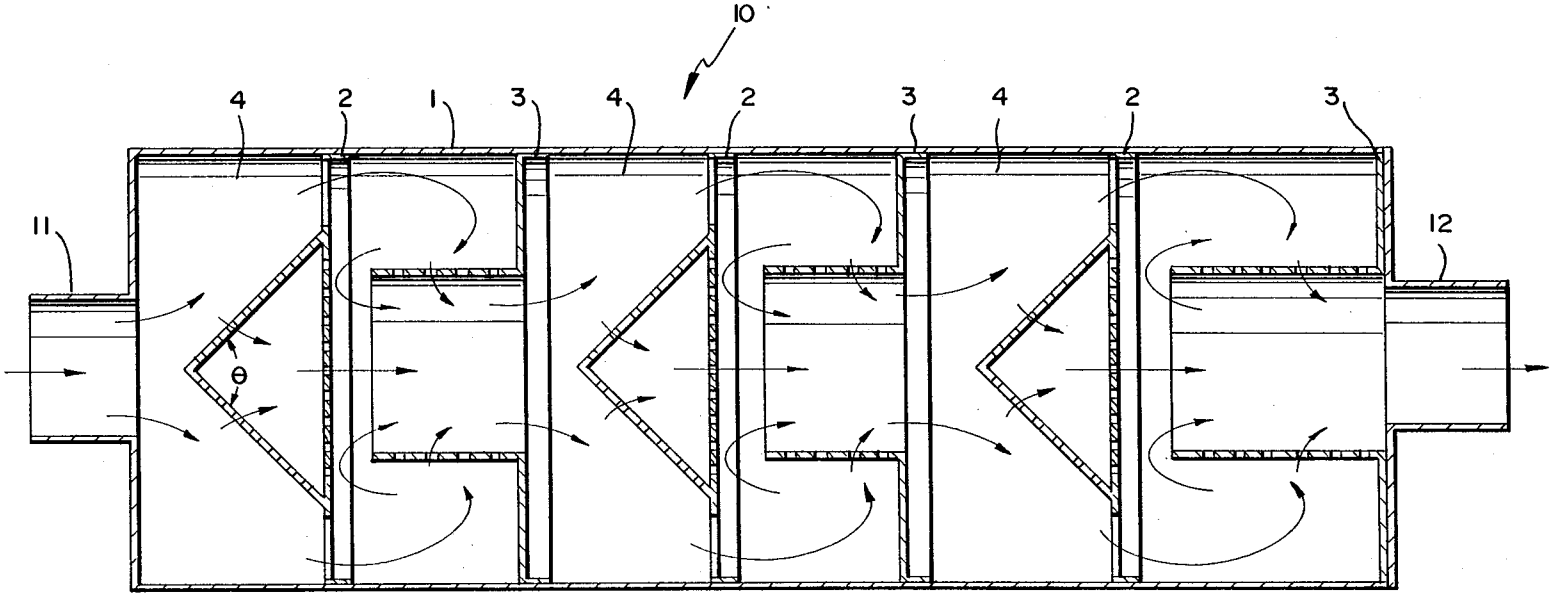
FIG. 4 is a longitudinal cross sectional view of the same muffler as shown in FIG. 3 wherein the arrows indicate the flow paths of the exhaust through the muffler.

FIGS. 3 and 4 depict the detailed construction of a muffler 10 of the present invention. The main body 1 of the muffler 10 is in the form of main cylinder. At both ends of the main cylinder are two connecting pipes 11 and 12 installed in the direction of the main cylinder with their diameters reduced to smaller ones in order to connect directly with an exhaust pipe and an end pipe ( not shown in the Figures ) of a conventional exhaust system.

The inner space of the main body 1 is divided by several stainless steel circles 2 into separate spaces 4. The number of steel circular members 2 is preferably three. At the center of each steel circle 2 is cone 21 installed to the left side ( according to the direction shown in the Figures ) of circle 2. The cones 21 are connected with members 2 by a plurality of spaced spokes 22, and a plurality of openings 23 are formed between steel circles 2 and cones 21 so as to make the exhaust which enters the muffler 10 dissipate first and then be expanded and cooled gradually. The expanded and cooled exhaust then flows away from steel circles 2 through openings 23. The cone 21 is prferably integrated with the steel circle 2 as a single body to enable the entire structure to bear a high exhaust pressure. In the preferred embodiment, the tip or apex of cone 21 is exactly on the center axial line of the main body 1. In addition, the diameter of the base portion 24 of the cone 21 is larger than the inner diameter of connecting pipes 11 and 12. At the same time, the angle of the cone 21 is 90° which can make the exhaust expand uniformly. Of course, other appropriate angles can also be adopted. Another feature of cone 21 is having a series of orifices 25 on its surface. This design on the one hand can provide more paths to facilitate the flow of exhaust and on the other hand can eliminate the noise of exhaust and avoid the distortion of cone 21 under heat expansion.

On an appropriate position to the right side of the steel circle 2 is fixed a round barrier plate 3 which is also made of stainless steel. At the center of the round plate 3 is an opening 31 of which the inner diameter is larger than that of the connecting pipes 11 and 12 but smaller than the outer diameter of the base portion 24 of the cone 21. At the same time, a portion of plate 3 is extended leftward along the axial direction and around the opening 31 to form a cylinder 32. The cylinder 32 is preferably integrally formed with the barrier plate 3 as a single body and spaced from the steel circle 2 a sufficient distance to provide a flowing space. In addition, the surface of the cylinder 32 also has a series of orifices 33 which make the exhaust dissipate from cone 21 and flow through the steel circle 2 to be impeded by the barrier plate 3 and reflect back so as to reduce the flowing speed and prevent sound waves from forming and thus lowering the noise. The exhaust reflecting back partially flows into cylinder 32 through orifices 33 and partially flows into cylinder 32 through its entrance. Alterward the two parts of exhaust join together and flow out. After its dissipation through the several cones 21, intercepted by the several barrier plates 3, and muffled by orifices 25 and 33, the noise of the exhaust is gradually lowered. The exhaust then becomes calm and quiet, and engine can exhaust smoothly.

Although the above description is made of a single embodiment, it should be noted that this embodiment is only an example of the many embodiments which can show the effect of the present invention. Accordingly, this embodiment is only used to illustrate the invention. Various changes or revisions may be made by those who are familiar with such technology in accordance with the subjoined claims.

What is claimed is:

1. A muffler comprising:

(a) a hollow cylindrical body having an input end and an output end;

(b) a plurality of cone assemblies longitudinally spaced along an interior of the body, each cone assembly including a conical member having an apex directed towards the input end of the body and aligned with a longitudinal axis thereof;

(c) a plurality of barrier assemblies longitudinally spaced along the interior of the body and alternately disposed between the cone assemblies, each barrier assembly including a round plate provided with a central circular opening and an open ended hollow cylindrical portion surrounding the opening and extending outwardly of the plate towards the input end of the body; and (d) each cone assembly and each barrier assembly being provided with a plurality of exhaust flow paths therethrough.

2. The muffler of claim 1 wherein each cone assembly further includes a circular member, a plurality of spaced spokes joining the conical member to the circular member at a center thereof, a plurality of orifices formed through the conical member, and the exhaust flow paths of each cone assembly including spaces between the spokes and the orifices formed in the conical member.

3. The muffler of claim 2 wherein the conical member of each cone assembly further includes a base member provided with a plurality of orifices formed therethrough.

4. The muffler of claim 2 wherein each cone assembly is integrally formed of stainless steel.

5. The muffler of claim 1 wherein the cylindrical portion of each barrier assembly includes a plurality of orifices formed in a wall thereof, and the exhaust flow paths defined by each barrier assembly includes the orifices formed in an wall and the open ended space defined by the cylindrical portion and the central opening.

6. The muffler of claim 1 wherein a cone angle of each conical member is ninety degrees.

7. The muffler of claim 1 wherein the input and output ends of the body each includes a cylindrical connecting pipe of a same diameter and each conical member having a base diameter that is greater than the diameter of the connecting pipes.

8. The muffler of claim 6 wherein the diameter of each cylindrical portion is smaller than the base diameter of each conical member and larger than the diameter of the connecting pipes.

9. The muffler assembly of claim 1 wherein each barrier assembly is integrally formed of stainless steel.

10. The muffler of claim 1 including three cone assemblies and three barrier assemblies.

* * * * *